US010123943B2

(12) United States Patent
Patil et al.

(10) Patent No.: US 10,123,943 B2
(45) Date of Patent: Nov. 13, 2018

(54) PORTABLE DEVICE FOR CUTTING A CAPSULE

(71) Applicant: Sun Pharma Advanced Research Company Limited, Mumbai (IN)

(72) Inventors: Satyashodhan Patil, Baroda (IN); Prashant Kane, Baroda (IN); Nitin Dharmadhikari, Mumbai (IN); Yashoraj Zala, Mumbai (IN); Satish Madhukar Gokhale, Pune (IN); Manish Ramdas Bagul, Pune (IN); Nachiket Vilas Gole, Pune (IN)

(73) Assignee: Sun Pharma Advanced Research Company Limited, Maharashtra (IN)

( * ) Notice: Subject to any disclaimer, the term of this patent is extended or adjusted under 35 U.S.C. 154(b) by 0 days.

(21) Appl. No.: 15/438,303

(22) Filed: Feb. 21, 2017

(65) Prior Publication Data

US 2017/0239143 A1 Aug. 24, 2017

(30) Foreign Application Priority Data

Feb. 20, 2016 (IN) ..... 201621005956

(51) Int. Cl.
*A61J 7/00* (2006.01)

(52) U.S. Cl.
CPC ..... *A61J 7/0007* (2013.01); *A61J 7/0076* (2013.01)

(58) Field of Classification Search
CPC ..... A61J 7/0007; A61J 7/0076; A61J 1/035; Y10S 241/27; B65D 83/04; B65D 83/0409; B65D 85/1009
See application file for complete search history.

(56) References Cited

U.S. PATENT DOCUMENTS 5,118,021 A * 6/1992 Fiocchi ..... A61J 7/0007 225/103
5,464,118 A * 11/1995 Grau ..... B65D 83/0463 206/531
7,562,790 B2 * 7/2009 Wheeler ..... A61J 7/0007 206/538
8,327,610 B1 * 12/2012 Ray, II ..... A61M 15/0036 128/203.21
2008/0078797 A1 * 4/2008 Frick ..... A61J 7/0007 225/93
2010/0258565 A1 * 10/2010 Isaacson ..... B09B 3/0075 220/324
2014/0246525 A1 * 9/2014 Young ..... B02C 19/08 241/3
2017/0239143 A1 * 8/2017 Patil ..... A61J 7/0007

FOREIGN PATENT DOCUMENTS

GB 2253200 A * 9/1992 ..... A61J 3/07

* cited by examiner

*Primary Examiner* — Frederick C Nicolas
*Assistant Examiner* — Bob Zadeh
(74) *Attorney, Agent, or Firm* — Davidson, Davidson & Kappel, LLC

(57) ABSTRACT

A portable device for cutting a capsule which has been filled with a drug formulation is configured to allow for the accurate alignment of the capsule in the capsule holder and includes a blade shaped to cut the upper portion of the capsule so as to open and dispense the drug formulation without any spillage, and the cut end is disposed capably without falling back in the medication. The device operates accurately with different capsule sizes, even with smaller capsule size when dose content is low, and provides a reliable and precise technique for splitting capsules.

8 Claims, 11 Drawing Sheets

PORTABLE DEVICE FOR CUTTING A CAPSULE

TECHNICAL FIELD OF INVENTION

The present invention relates generally to patient care devices and, more particularly, to portable devices for cutting of medication-filled capsules and releasing the medicament therefrom.

BACKGROUND

The most common pharmaceutical dosage forms for oral administration include compressed tablets and capsules. These dosage forms are large in size and must be taken by swallowing them generally with a liquid. Mostly paediatric and geriatric patients have a difficulty in swallowing them or are unable to swallow them.

Conventionally, the tablet is crushed into a powder or the drug formulation in the form of powder, granules or pellets is taken out of the capsule and is then administered along with an edible carrier that is easily accepted by a patient, for example, honey, curd, custard, juices or just plain water. Whereas this method is particularly difficult for elderly and weak patients, who have problems of dexterity, even nursing staff may find it difficult to hold, open and dispense the powder or granular contents therein without spillage and loss of a part of the dose.

Therefore, there is a need, heretofore not met, for providing a device for cutting capsules filled with drug formulation and simultaneously forming a passageway for dispensing a drug formulation, particularly transferring or sprinkling onto an edible carrier such as honey or soft food, without spillage.

SUMMARY OF THE INVENTION

The present invention provides a portable device for cutting capsules filled with a drug formulation and simultaneously forming a passageway for dispensing the drug formulation.

Particularly, in one embodiment, the portable device of the present invention comprises:

(a) a housing having a capsule holding cavity;
(b) a cap hingedly secured to the housing, the cap comprising a tubular element leading to an exit port; and
(c) a means for moving a blade to cut the capsule and simultaneously engage the tubular element from over the mouth of the cut capsule to the exit port forming a passageway for dispensing the drug formulation without spillage.

Specifically, in one embodiment, the portable device of the present invention comprises (a) a housing having a capsule holding cavity;
(b) a cap hingedly secured to the housing, the cap comprising a tubular element leading to an exit port; and
(c) a means for moving a blade to cut the capsule and simultaneously engage the tubular element from over the mouth of the cut capsule to the exit port forming a passageway for dispensing the drug formulation without spillage, wherein the means for moving a blade comprises
  (i) a blade holder mounted over two parallel guideways on the surface of the housing, said blade holder having at least one blade;
  (ii) one or more linkages pivotally connecting the blade holder to the cap, such that when the cap is closed, the blade holder slides over the guideways from proximal end to distal end of the housing thereby cutting the capsule; and
  (iii) a guard wall for displacing top part of cut capsules towards the opening at the distal end of the housing.

In another Specific embodiment, the portable device of the present invention comprises (a) a housing having a capsule holding cavity;
(b) a cap hingedly secured to the housing, the cap comprising a tubular element leading to an exit port; and
(c) a means for moving a blade to cut the capsule and simultaneously engage the tubular element from over the mouth of the cut capsule to the exit port forming a passageway for dispensing the drug formulation without spillage,
(d) wherein housing further comprises push button to eject the lower cut portion of the capsule.

BRIEF DESCRIPTION OF THE DRAWINGS

The various embodiments of present invention are described in detailed description with the accompanying drawings, in which.

Figure 1:
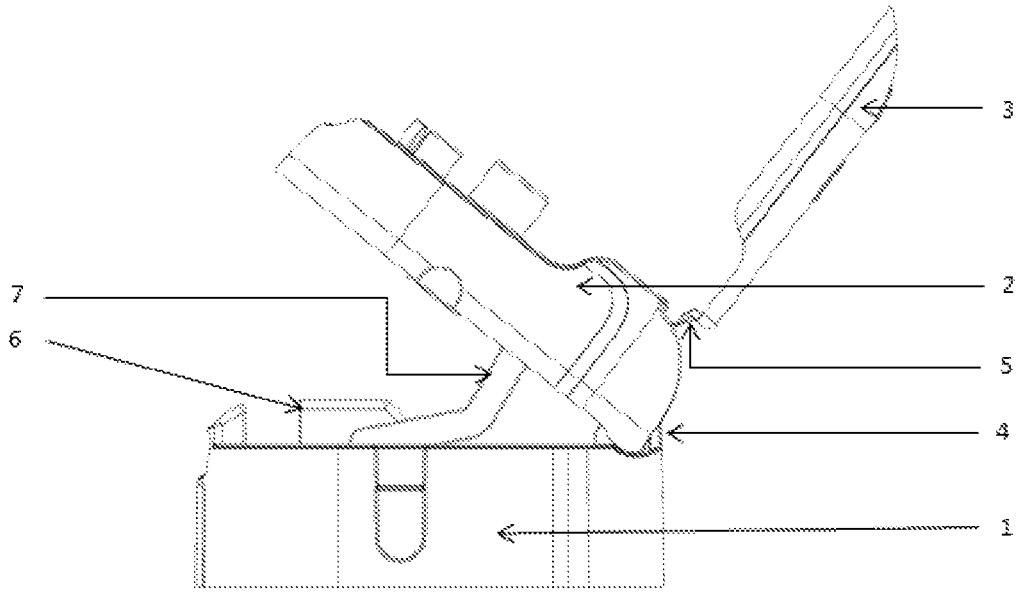
FIG. 1 shows an illustration of side view of an exemplary embodiment of the present invention with the cap in half opened condition.

The annotations used in the above figures are as follows:

1 Housing
2 Cap
3 Lid
4, Hinge
5, Hinge
6 Blade holder
7 Linkages
8 Blade
9 Guide-ways
10 Capsule holding cavity
11 Tubular element -continued 12 Passage-way
13 bottom of housing
14 Joint plate
15 Opening
16 Spout lock
17 Exit port
18 Lid-lock
19 Projection
20 Protrusion
21 Guard wall
22 Lower undercut
23 Upper undercut
24 Mesh structure
25 Proximal end of housing
26 Distal end of housing
27 Hinge
28 Intact capsule
29 Cut top portion of the capsule
30 Cut bottom portion of the capsule
31 Drug Formulation
32 Pillars
33 Push Button
34 Left Bush
35 Right Bush
36 Bottom Cap
37 Capsule Holder Cavity
38 Cut dome portion of capsule

DETAILED DESCRIPTION OF THE PRESENT INVENTION

The portable device of the present invention offers cutting capsules which are filled with a drug formulation while simultaneously forming a passageway for dispensing the drug formulation.

Particularly, in one embodiment, the portable device of the present invention comprises:

(a) a housing having a capsule holding cavity;
(b) a cap hingedly secured to the housing, the cap comprising a tubular element leading to an exit port; and
(c) a means for moving a blade to cut the capsule and simultaneously engage the tubular element from over the mouth of the cut capsule to the exit port forming a passageway for dispensing the drug formulation without spillage.

Specifically, in one embodiment, the portable device of the present invention comprises (a) a housing having a capsule holding cavity;
(b) a cap hingedly secured to the housing, the cap comprising a tubular element leading to an exit port; and
(c) a means for moving a blade to cut the capsule and simultaneously engage the tubular element from over the mouth of the cut capsule to the exit port forming a passageway for dispensing the drug formulation without spillage, wherein the means for moving a blade comprises
  (i) a blade holder mounted over two parallel guideways on the surface of the housing, said blade holder having at least one blade;
  (ii) one or more linkages pivotally connecting the blade holder to the cap, such that when the cap is closed, the blade holder slides over the guideways from proximal end to distal end of the housing thereby cutting the capsule; and
  (iii) a guard wall for displacing top part of cut capsules towards the opening at the distal end of the housing.

The portable device of the present invention allows to cut the upper portion of the capsule which has been filled with a drug formulation so as the open and dispense the drug formulation without any spillage. Particularly, the drug formulation is dispensed from a passageway that is formed simultaneously, while the capsule is being cut. This allows accurate dosing of the drug formulation without any chances of spillage or wastage, while the drug formulation is being dispensed. The lower cut portion of the capsule is ejected by pressing the push button.

In another specific embodiment, the portable device of the present invention comprises (a) a housing having a capsule holding cavity;
(b) a cap hingedly secured to the housing, the cap comprising a tubular element leading to an exit port; and
(c) a means for moving a blade to cut the capsule and simultaneously engage the tubular element from over the mouth of the cut capsule to the exit port forming a passageway for dispensing the drug formulation without spillage,
(d) wherein housing further comprises push button to eject the lower cut portion of the capsule.

In one specific embodiment, the housing portion of the device is comprised of (a) guide-ways for the movement of a blade holder linked to the cap.
(b) Capsule holding cavity
(c) Optionally, an impression or carving indicating the vertical capsule position to guide user for the positioning of the capsule
(d) an opening
(e) a groove and protrusion to help open the cap latched to the housing.

In another specific embodiment, the housing portion of the device is comprised of (a) guide-ways for the movement of a blade holder linked to the cap.
(b) Capsule holding cavity
(c) Optionally, an impression or carving indicating the vertical capsule position to guide user for the positioning of the capsule
(d) an opening
(e) a groove and protrusion to help open the cap latched to the housing
(f) a push button to eject the lower cut portion of capsule.

Generally, the length of housing can accommodate width of at least two fingers of the user with enough space in between for easy grip.

The housing of the device includes guideways for the movement of a blade holder linked to the cap, which is the upper portion above the housing. The guide-ways may be linear or curved. The guideways may be composed of rails and ball bearings for rolling movement or a master-rail (T rail) and a slave-rail (U rail) option to allow movement of the blade holder preventing possible system misalignment. In another embodiment, the guideways can have guided roller wheel or rack and pinion mechanism for linear movement. In another embodiment, the guideways can be in the form of magnetic contactless guides that are floating in air for frictionless movement. In another embodiment, the blade can be mounted on a chain and timer wheel mechanism or pulley and wire mechanism for linear movement. In another embodiment, the guiding mechanism can be spring loaded so that the blade is in constant contact with the platform surface so as to reduce vertical misalignment of the blade during the cutting operation. In another embodiment, the guiding mechanism can be in the form of hydraulic or pneumatic piston and cylinder. Particularly, there are two guide-ways running parallel to each other on the top surface of the housing and the capsule holder is placed exactly at the centre of the two tracks of the guideways. The two sides of the blade holder holding the blade is mounted on the guideways. The guideways allows the blade holder to move to and fro in the direction of the distal end to the proximal end of the device. The cutting action takes place when the blade is moving from the proximal end of the device to the distal end. In another embodiment, the blade can be in the opposite direction and the cutting action takes place when the blade is pulled from the distal end to the proximal end of the device when the cap is opened. In another embodiment the cap can be mounted on rotary guides on the body and the blade held by the cap such that the cutting action takes place in a rotary motion and the tubular element then aligns over the cut capsule.

The housing includes one or more capsule holding cavities. The capsule holding cavity may have ribs on the inner surface of the cavity so as to firmly hold the capsule during the process of cutting as well as after cutting. The ribs further do not allow the capsule to stick to the walls of holder. The capsule holding cavity may be made flexible by use of polymer, more preferably Thermoplastic elastomers (TPE), such as polyurethane and polyamides. The capsule holding cavity can be of different sizes to accommodate different dimensions of the capsule. This capsule holding cavity may accordingly be adapted to various sizes depending upon the sizes of the capsule ranging from capsule 0 to 0 EL, 1, 2, 3 etc. Capsule holding cavity may be made of softer material having enough strength for multiple uses. The capsule holding cavity is designed to hold the capsule in the vertical position that is perpendicular to the position of the guideways on which the blade holder having the blade runs to and fro in the direction of the distal end to the proximal end of the device. The outer wall of the housing may also have an impression to show the position of the capsule in the housing to guide user for correctly placing the capsule. The housing of the device may further include serrations or grooves on its outer surface for providing proper grip during use.

Figure 3:
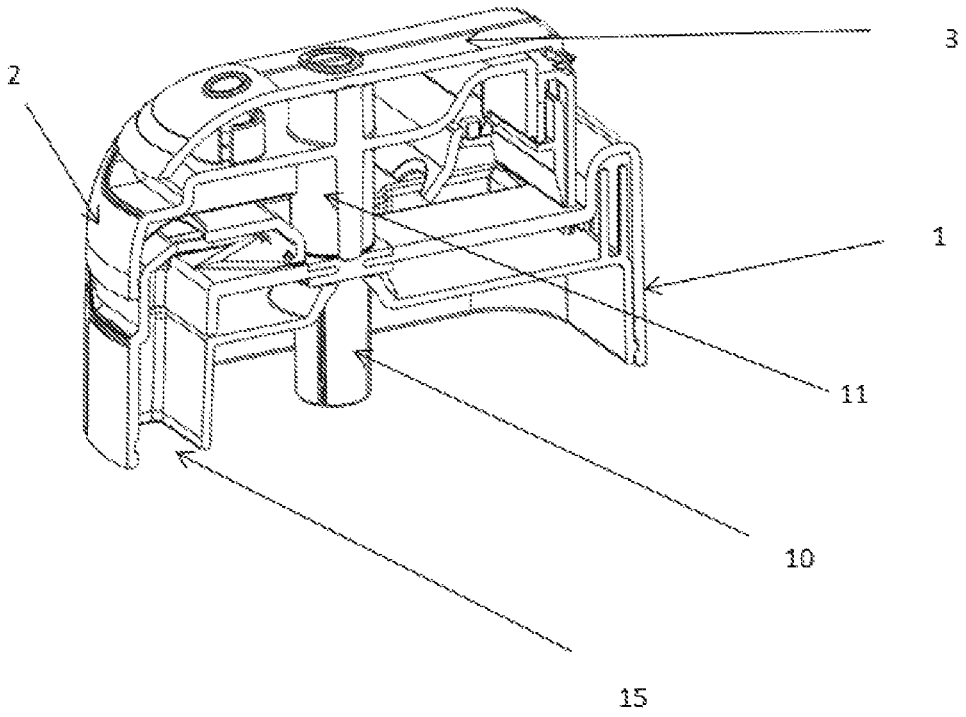
FIG. 3 shows an illustration of isometric cross section view of an exemplary embodiment of the present invention with the cap in closed condition.

In one aspect of the invention, the housing includes an opening which is located at the distal end of the device on the bottom side, away from the position of the blade. This is provided for disposal of the cut top portion of capsule which travels towards the distal end of the device, due to movement of the blade holder or its attached components such as guard wall, towards the distal end, as soon as the capsule is cut. In order to remove the cut bottom portion of the capsule, the region below the capsule holder may be either open so as to give finger access to the capsule holding cavity for discarding the bottom cut portion of capsule from the device or the bottom of the housing may be open, as depicted in FIG. 3. The housing optionally, also has a protrusion for securing the cap when the device is closed.

In one aspect of the present invention, the housing of the device is connected to the cap with the help of hinges placed at the proximal end of the device. The cap is connected to the lid with the help of hinges on the proximal end. The cap comprises a tubular element leading to an exit port though which the medication or drug formulation is dispensed. In one specific embodiment, it is located on the top part of the cap. Particularly, in specific embodiment, the exit port has an integrated mesh like structure inside it and is used to get the drug formulation sprinkled or delivered at different spots or series of adjacent spots (at least 3-4 places) instead of piling on one place. Design and size of the mesh is such that it does not allow granules of the drug accumulation on it. The wires in the mesh may be circular or triangular that does not allow the granules of the drug to settle. Top surface of cap has another projection which is used to fit a lid to the cap.

The device of the present invention, in one specific embodiment includes, means for moving a blade to cut the capsule and simultaneously engage the tubular element from over the mouth of the cut capsule to the exit port forming a passageway for dispensing the drug formulation without spillage, wherein the means for moving a blade comprises (i) a blade holder mounted over two parallel guideways on the surface of the housing, said blade holder having at least one blade;

(ii) one or more linkages pivotally connecting the blade holder to the cap, such that when the cap is closed, the blade holder slides over the guideways from proximal end to distal end of the housing thereby cutting the capsule; and (iii) a guard wall for displacing top part of cut capsules towards the opening at the distal end of the housing, the said means located between the housing and the cap.

In one specific embodiment, the blade holder can hold a suitable blade in required orientation. Blade holder is connected to the cap of the device through two linkages on both sides of the blade holder and can slide through the guideways provided on the housing. In one specific embodiment, the two linkages are generally joined together with the help of a component such as plate which also provides additional strength to the linkages.

The linkages help in pushing and pulling the blade holder over the guide ways during operation. The blade holder also acts as a shield and prevent user from unsuspectingly touching the blade. The blade may be of different size and shape. The blade may have sharp edge or with blade with serration. A triangular shape may be preferred such that it first pierce and then cuts the capsule with use of minimum force. After the blade cuts the capsule, the top cut portion of capsule is pushed out of the device though an opening provided at one end of the housing thereby avoiding the portion getting stuck in the guide ways and jamming the movement of blade. The blade holder may be adapted to have a guard wall that pushes the top cut portion towards an opening at one end of the housing helping the dispense of the top cut portion of capsule. The opening is towards the bottom direction of the housing and is provided for disposal of the top cut portion of capsule from the device as soon as the capsule is cut. Housing also has a protrusion for securing the cap when the device is closed.

The cap of the device optionally may have a lid. The lid is used to close the opening of the exit port. The lid additionally has another projection that helps to securely lock itself to the cap such that after cutting the capsule and turning the device, user has control on the delivery of medication. This ensures that drug formulation delivery occurs at desired place at desired time and eliminates chances of delivery at improper place and at improper time. This also gives flexibility to the user to turn the device at different orientation having the drug formulation inside. This is further useful in avoiding dust particles or moisture going inside the device when the device is not in use thereby reducing possible contamination.

In order that the invention may be well understood, there will now be described some embodiments thereof, given by way of example, reference being made to the accompanying drawings.

The device, as shown in the FIG. 1, is comprised of a housing (1), a cap (2) and a lid (3). The cap (2) is connected to the housing (1) and the lid (3) is connected to cap (2) via hinges (4) and (5) respectively. The cap (2) is also connected to a blade holder (6) through linkages (7).

Figure 2:
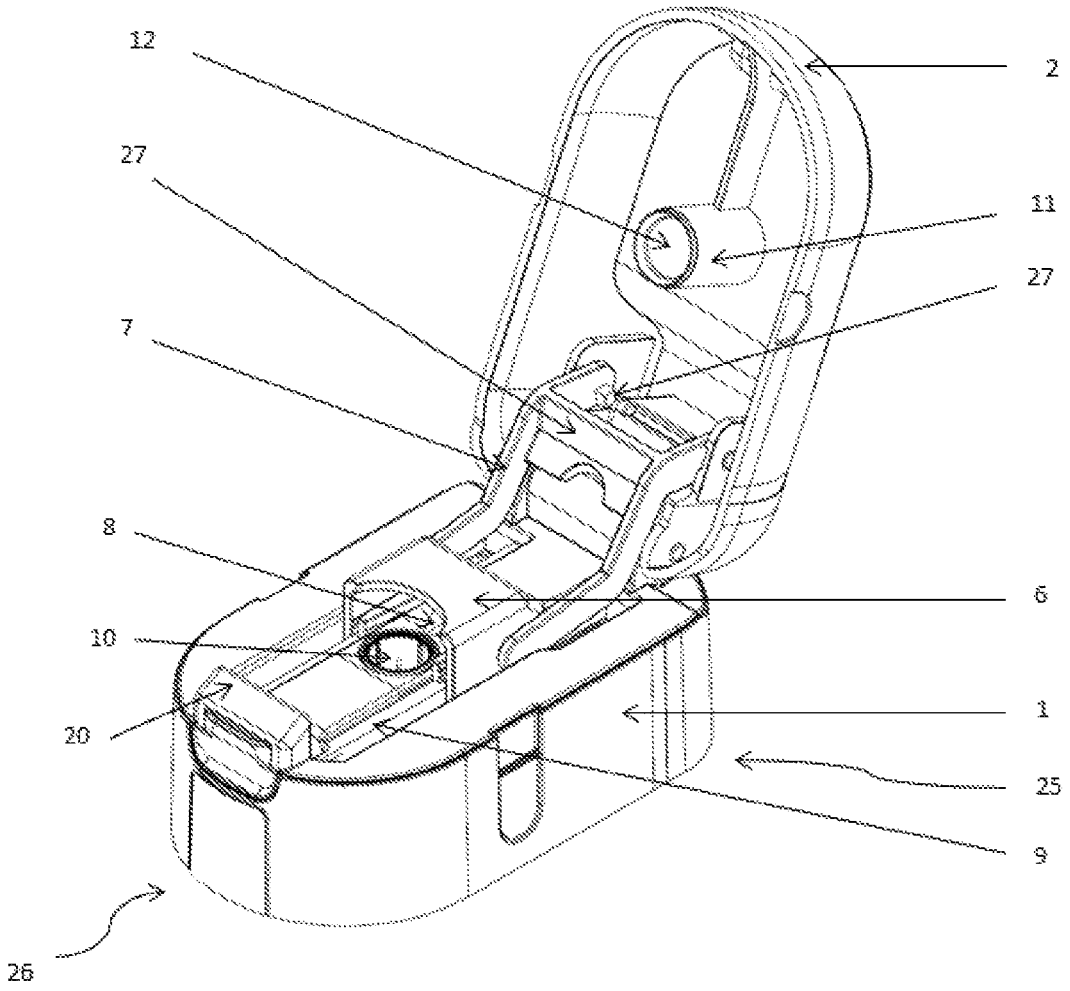
FIG. 2 shows an illustration of isometric view of an exemplary embodiment of the present invention.

Blade holder (6) holds the blade (8) and this sub assembly slides through the guide-ways (9) provided on housing (1) as shown in FIG. 2. Linkages (7) are connected to the cap (2) via hinges (27). Joint plate (14) is used to keep two linkages (7) joined together and also to provide adequate strength.

The device also has capsule holding cavity (10) assembled on housing (1) as shown in FIG. 2. Capsule holding cavity (10) is used to hold a capsule firmly at its place and is provided with ribs on the inner side for firm holding of capsule containing drug formulation. The cap (2) also has a tubular element (11) from inner surface which rest on capsule holding cavity (10) forming a passageway (12) between the capsule holding cavity (10) and an exit port (17), when device is in closed condition. This passageway (12) is used for the delivery of the medication from cut capsule. The protrusion (20) on distal end (26) of the housing (1) is used to lock the cap (2) securely with housing (1). FIG. 3 shows the device with the cap in closed condition with the passageway (12) formed by linear alignment of the capsule holding cavity (10) of the housing, the tubular element (11) of the cap leading to an exit port (17).

Figure 4:
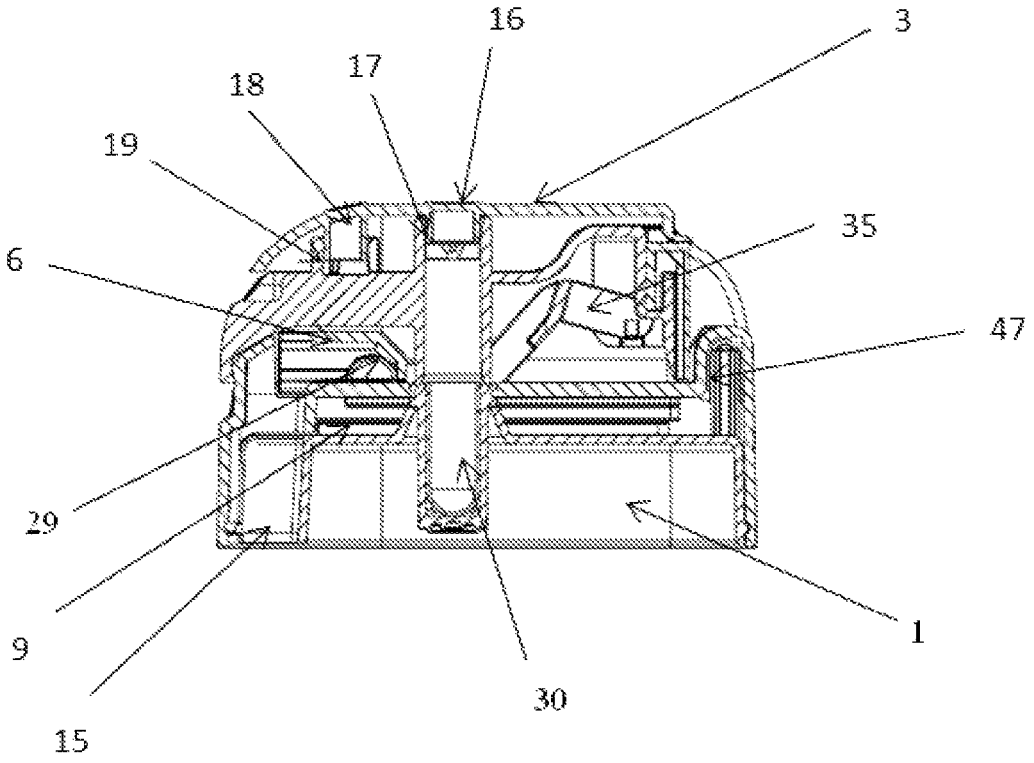
FIG. 4 shows an illustration of cross section side view of an exemplary embodiment of the present invention in closed condition of the device.

The operative mode of the device may be seen in FIG. 4 where the blade holder (6) has travelled through the guide-ways (9) to cut a capsule separating the top portion (29) of the capsule from an intact capsule. An opening (15) is provided for disposal of capsule dome from the device as soon as the capsule is cut (also seen in FIG. 3) at the bottom of housing (13).

The lid (3) has a spout lock (16) that fits into the exit port (17). Spout lock (16) is helpful in avoiding undesired delivery of the medication and also in avoiding spillage of the medication outside exit port (17). The lid (3) has an additional projection, the lid-lock (18) that fits to a projection (19) on the cap (2), also shown in FIG. 4. This lid-lock (18) functions to latch the lid (3) with the cap (2) of the device.

Figure 5:
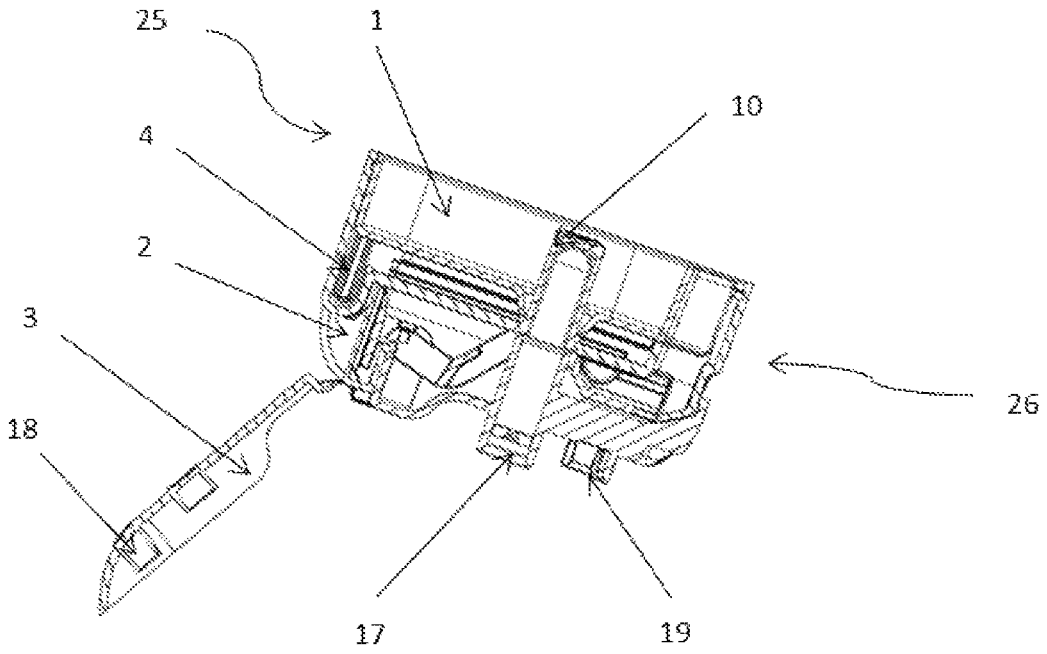
FIG. 5 shows an illustration of cross section side view of an exemplary embodiment of the present invention in tilted dispensing position of the device.

When the device is tilted as shown in FIG. 5, delivery of the medication takes place through the exit port (17) with the lid (3) in opened condition. Hinge joint (4) is used to connect the cap (2) to housing (1) which facilitates the opening and closing of the cap (2). Ribs are provided on the inner surface of the capsule holding cavity (10) for holding the capsule firmly.

Figure 6:
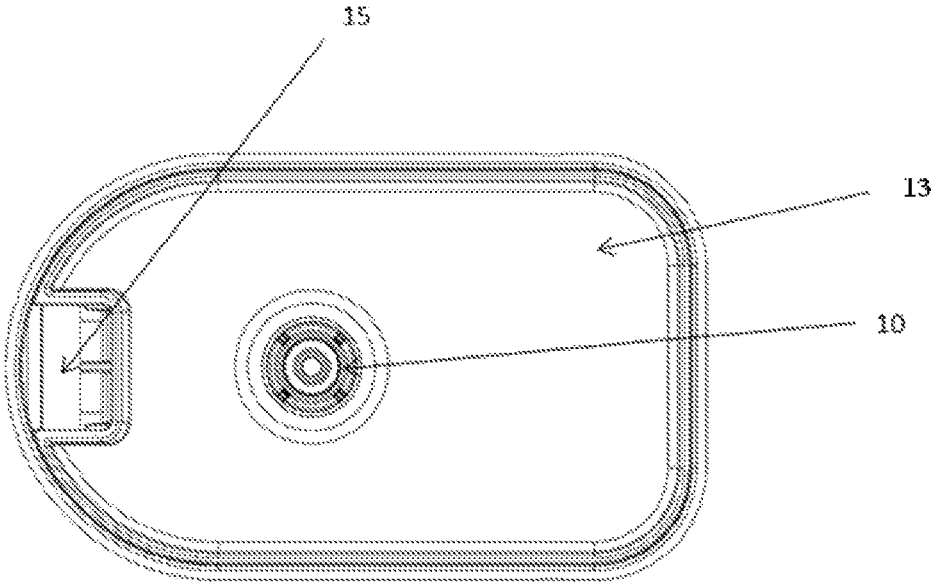
FIG. 6 shows an illustration of bottom view of an exemplary embodiment of the present invention.

The bottom view of the device is shown in FIG. 6 where capsule holding cavity (10) is seen from outside. The capsule holding cavity is made of a flexible polymer that helps in disposal of used cut capsule when pressure is applied on push button (33) from bottom.

Figure 7:
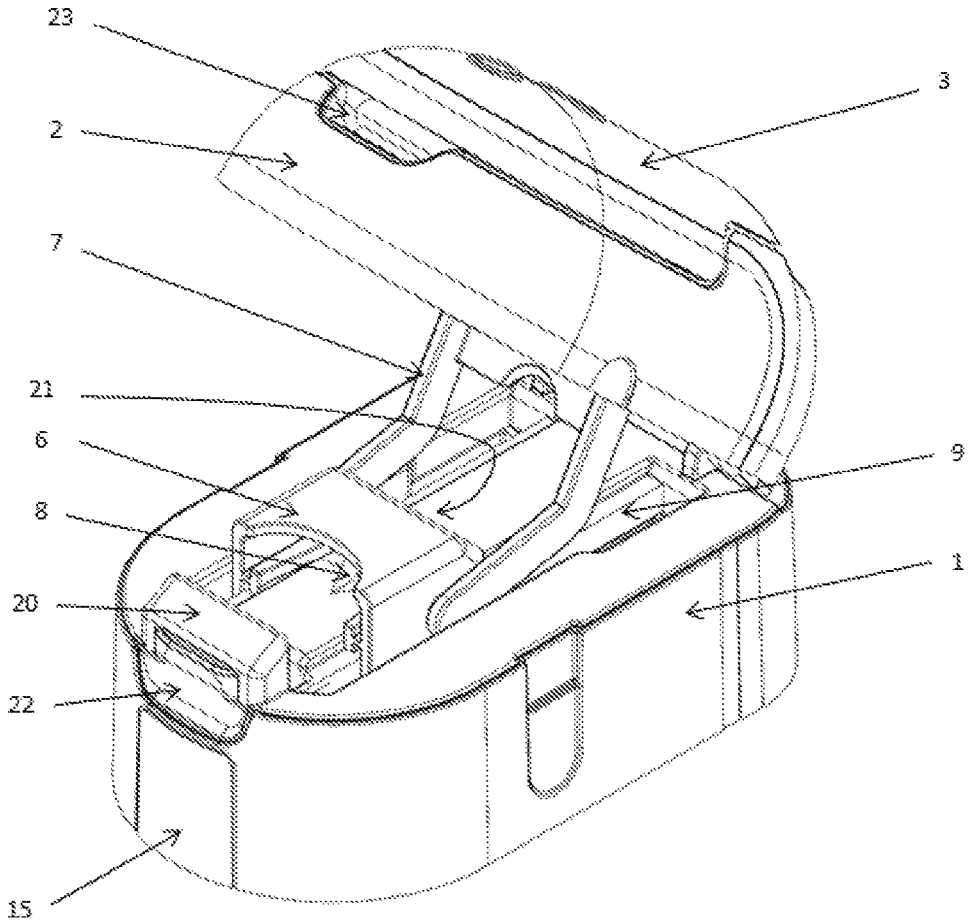
FIG. 7 shows an illustration of isometric front view of an exemplary embodiment of the present invention with middle cap half opened condition.

The isometric front view of device where the cap (2) is half opened condition is shown in the FIG. 7. Blade holder (6) holding the blade (8) as it slides through the guide-ways (9) to first pierce and then cut through the capsule (not seen). The blade holder (6) also has a guard wall (21). The blade holder (6) travels till the end of the glide-ways, thereby cutting and pushing the cut capsule dome to the opening (15). The closed (final) position of the blade holder (6) is seen in FIG. 5. The lower undercut (22), seen in FIG. 7, is used to facilitate easy opening of the lid (3) from the cap (2), while upper undercut (23) is used to facilitate easy opening of the cap (2) from the housing (1).

Figure 8:
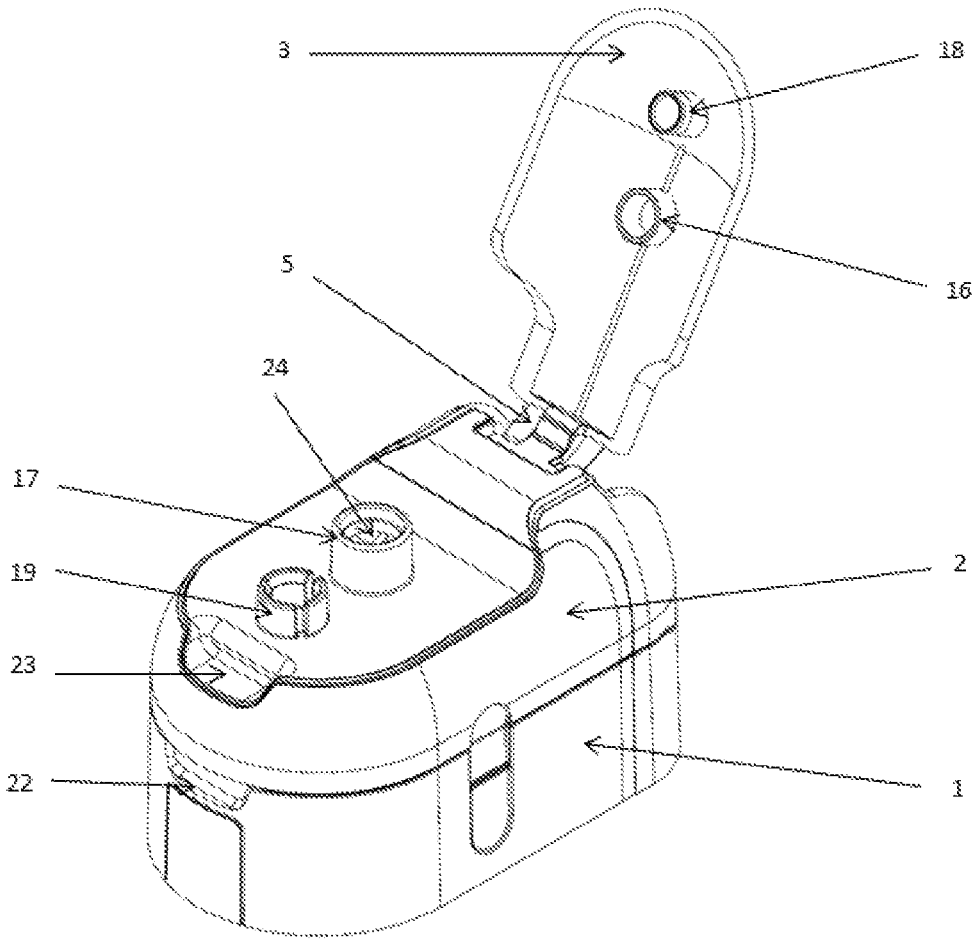
FIG. 8 shows an illustration of isometric front view of an exemplary embodiment of the present invention with top cap fully opened condition.

The device with its lid (3) is in fully opened condition, as shown in FIG. 8 shows hinge (5) that connects the lid (3) to the cap (2) of the device. Mesh structure (24) is provided inside the exit port (17) to get the drug formulation sprinkled or delivered at different spots instead of piling on one place. The figure also shows spout lock (16) that fits to the exit port (17) and lid-lock (18) that fits to the projection (19). The lower undercut (22) and upper undercut (23) helps is easy opening of cap (2) and lid (3) respectively are also seen in this figure.

Figure 9:
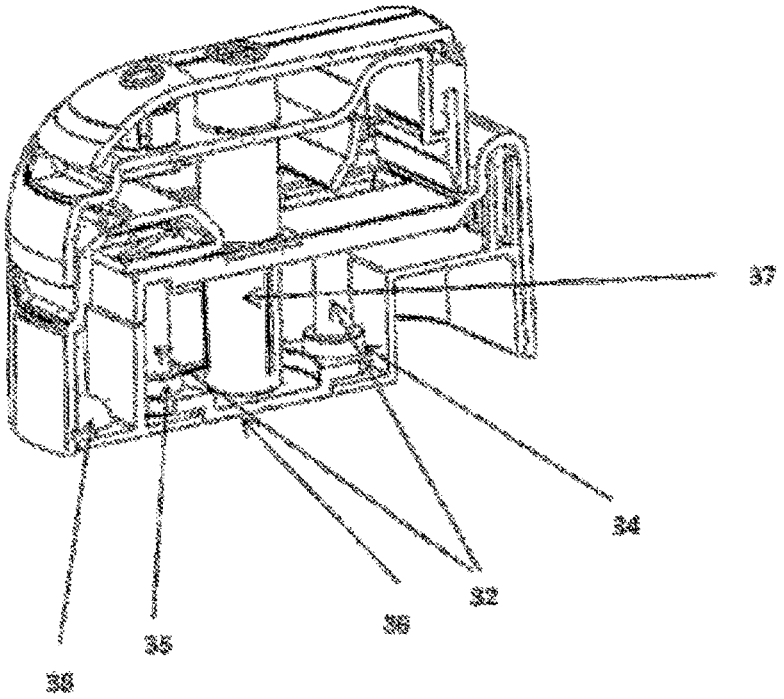
FIG. 9 shows an illustration of cross section side view of an exemplary embodiment of the present invention with pillars and a push button.

As shown in FIG. 9, the bottom cap (36) covers or encloses the pillars (32), capsule holding cavity (10) and push button (33). The pillars (32) are mounted vertically or perpendicularly to the base of bottom cap (36) which assembles or engages with the bushes (34, 35) providing the push button (33) flexibility to move smoothly and correctly "to and fro" or "upward and downward".

Figure 10:
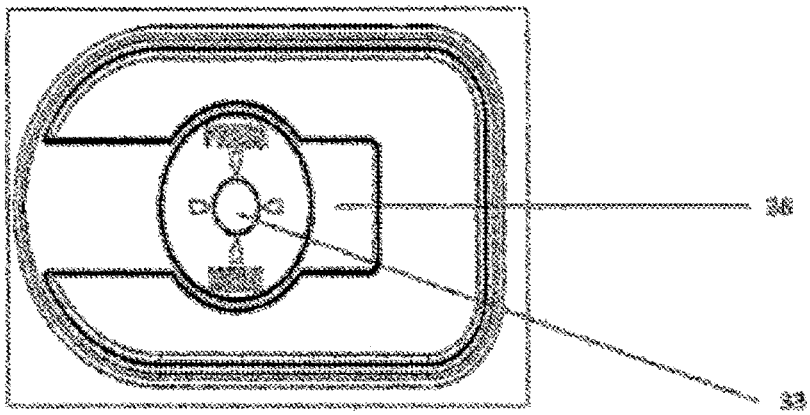
FIG. 10 shows an illustration of bottom view of an exemplary embodiment of the present invention with bottom cap and a push button.

In one specific embodiment of the device of present invention as shown in FIG. 10, the bottom of the device comprises of bottom cap (36) which covers or encloses the pillars (32) capsule holding cavity (10) and push button (33). The push button (33) rests in original position when not pressed upward. On pressing of push button (33), the capsule holder cavity gets compressed and ejects the lower cut portion of capsule out of capsule holding cavity (10). On releasing the push button (33), the capsule holder cavity takes its original position.

In another specific embodiment, the push button (33) is supported by multiple bushes (34, 35) which form an integral part of push button (33). The multiple bushes assembles or engages loosely with multiple pillars (32) to provide smooth and correct "to and fro" or "upward and downward" movement of the push button (33). The bushes used in the device of the present invention may be of any shape known in the art preferably circular, semi-circular etc.

Figure 11:
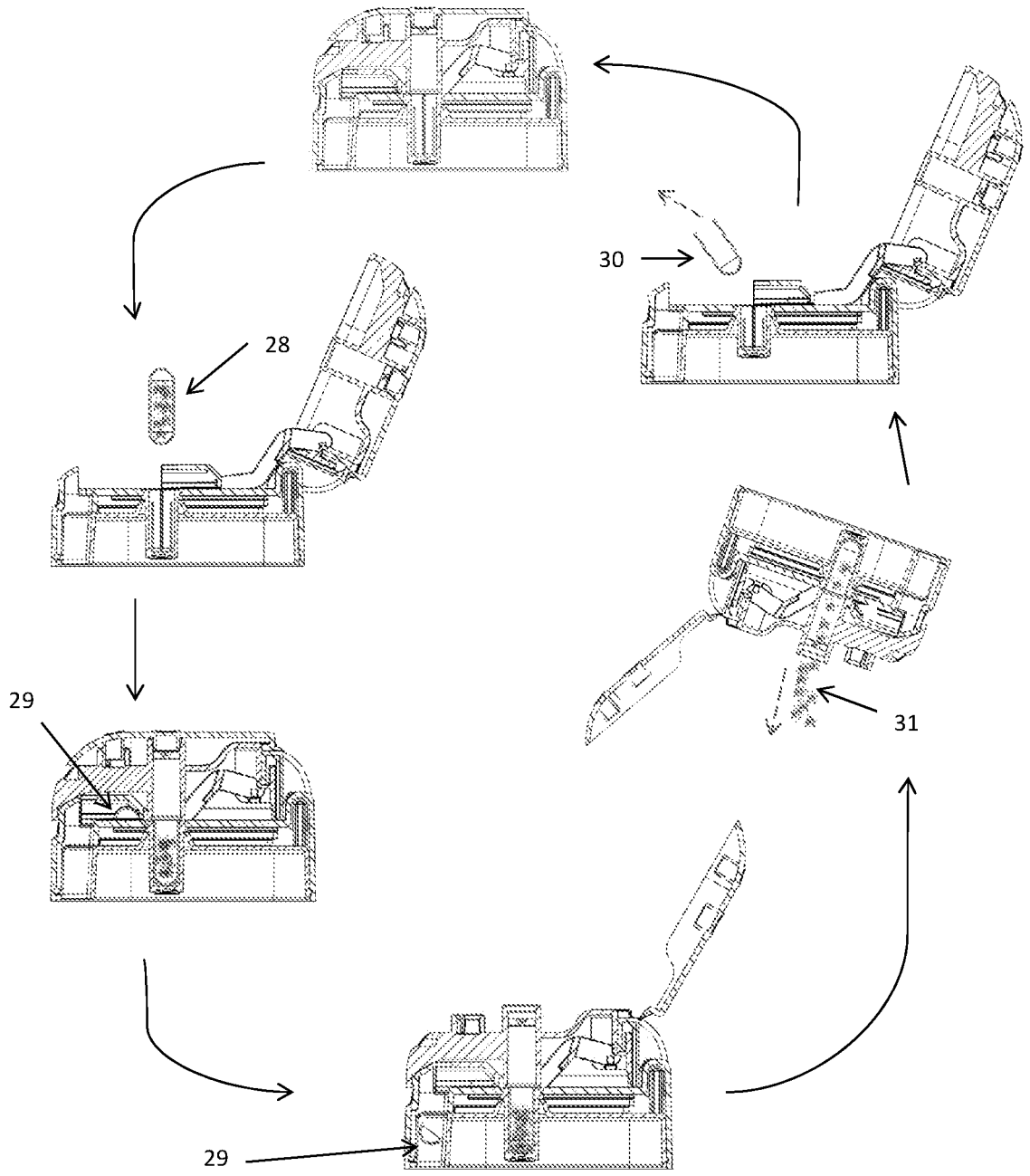
FIG. 11 shows operation of the device using cross sectional side views of an exemplary embodiment of the present invention.

The mode of operation of one of the embodiment is shown in FIG. 11. The cap (2) of the device is opened to put an intact capsule (28) containing a drug formulation (31) into the capsule holding cavity (10). The cap (2) is then closed when the blade holder (6) having a blade (8) slides through the guide-ways (9) thereby cutting top portion (29) of the capsule which is pushed by the guard wall (21) to opening (15).

When the cap (2) is in closed position, tubular element (11) engages capsule holding cavity (10) in a circular groove provided on the top surface of the capsule holding cavity (10). This engagement will create leak-proof path for medicine till the exit port (17). Thus, it will eliminate the risk of the spillage of the granules and consequently, minimise the possibility of incomplete dose to the user.

Capsule holding cavity (10) will have different inner diameter for holding the capsules based on specific size of the capsule keeping dimensions for outer surface of the capsule holding cavity (10) intact, however the outer diameter of the capsule holding cavity matches with the tubular element dimensions as shown in FIG. 4. In one embodiment, one single device suffices for different sizes of the capsules and in other embodiments, the capsule holding cavity is removable or replaceable with another capsule holding cavity for different size of the capsule. In embodiments, where one single device suffices for different sizes of capsules wherein for each size of the capsule, an appropriate capsule holding cavity can be mounted by the user. Alternatively, separate devices according to FIG. 4 may be designed for each size of the capsule, wherein in this embodiment, the capsule holding cavity is not removable or replaceable with another capsule holding cavity. When the drug formulation (31) is ready to be dispensed, the lid (3) that covers the exit port (17) is opened and the drug formulation is poured out through the exit port (17) by tilting the device over food or fluid which is to be consumed with the drug formulation (31). Thereafter when the push button (33) is pressed from button, the flexible capsule holding cavity (10) is compressed to eject off the cut bottom portion (30) of the capsule.

The present invention affords several advantages. For example, the device is easy to use and affords adequate mechanical advantage to the user that elderly or weak patients, having problems of dexterity, are able to operate the device without assistance. The device offers a reliable and precise technique for splitting capsules. The accurate alignment of the capsule in the capsule holder as well as the shape of blade ensures that the capsule is not damaged and that the cut end is disposed capably without falling back in the medication. The device operates accurately even with smaller capsule size when dose content is low. The invention further has an advantage of being adaptable to different capsule sizes rendering its use across different available capsule prototypes in the industry.

After cutting the upper portion of the capsule by blade, device is used to deliver or pour the drug formulation as desired by the user. The drug formulation comes out from the device through an opening, called the exit port, provided on top part of the device. This helps user to comfortably take the dose of drug without any additional packaging around the drug and also avoid spillage of the medication or drug formulation.

Although the invention is described and referred to specifically as it relates to specific devices, structures, machines and methods for cutting of medication-filled capsules, it will be understood that the principles of this invention are equally applicable to similar devices, structures and methods for cutting or slitting of medication-filled capsules, and accordingly, it will be understood that the invention is not limited to such devices, structures, machines and methods for cutting of medication-filled capsules.

The invention claimed is:

1. A portable device for cutting a capsule filled with a drug formulation and simultaneously forming a passageway for dispensing the drug formulation, said device comprising:

(a) a housing having a capsule holding cavity;

(b) a cap hingedly secured to the housing, the cap comprising a tubular element leading to an exit port; and (c) a means for moving a blade to cut the capsule and simultaneously engage the tubular element from over a mouth of the capsule to the exit port forming the passageway for dispensing the drug formulation without spillage when the capsule is cut by the blade; wherein the means for moving the blade comprises (i) a blade holder mounted over two parallel guideways on surface of the housing, said blade holder having at least one blade;

(ii) one or more linkages pivotally connecting the blade holder to the cap, such that when the cap is closed, the blade holder slides over the guideways from proximal end to distal end of the housing thereby cutting the capsule; and (iii) a guard wall for displacing top portion of the cut capsule towards the opening at the distal end of the housing.

2. The portable device of claim 1, wherein the opening of the housing towards the distal end provides for disposal of the cut top portion of the capsule.

3. The portable device of claim 1, wherein the capsule holding cavity is flexible.

4. The portable device of claim 3, wherein the capsule holding cavity is made up polymer selected from polyurethane or polyamides or combination thereof.

5. The portable device of claim 1, wherein the blade is triangular in shape.

6. The portable device of claim 1, wherein the exit port contains a mesh structure.

7. A portable device for cutting a capsule filled with a drug formulation and simultaneously forming a passageway for dispensing the drug formulation, said device comprising:

(a) a housing having a capsule holding cavity;

(b) a cap hingedly secured to the housing, the cap comprising a tubular element leading to an exit port; and (c) a means for moving a blade to cut the capsule and simultaneously engage the tubular element from over a mouth of the capsule to the exit port forming the passageway for dispensing the drug formulation without spillage when the capsule is cut by the blade; wherein the means for moving the blade comprises (i) a blade holder mounted over two parallel guideways on a surface of the housing, said blade holder having at least one blade;

(ii) one or more linkages pivotally connecting the blade holder to the cap, such that when the cap is closed, the blade holder slides over the guideways from proximal end to distal end of the housing thereby cutting the capsule; and (iii) a guard wall for displacing top portion of the cut the capsule towards the opening at the distal end of the housing; and wherein the cap further comprises a lid, hingedly secured to the cap, comprising (a) a spout lock for closing the exit port of the cap;

(b) a lid-lock for securing the lid with the cap.

8. The portable device of claim 7, wherein the capsule when cut comprises a lower cut portion and an upper cut portion, and wherein a bottom of the housing, comprises a push button with pillars for guiding upward and downward movement of the push button to eject the lower cut portion of the capsule.

* * * * *